US005830613A

United States Patent [19]

Carmichael et al.

[11] Patent Number: 5,830,613

[45] Date of Patent: Nov. 3, 1998

[54] ELECTROPHOTOGRAPHIC IMAGING MEMBER HAVING LAMINATED LAYERS

[75] Inventors: Kathleen M. Carmichael, Williamson; Kent J. Evans, Lima; Sharon E. Normandin, Macedon; Donald P. Sullivan, Rochester, all of N.Y.

[73] Assignee: Xerox Corporation, Stamford, Conn.

[21] Appl. No.: 937,321

[22] Filed: Aug. 31, 1992

[51] Int. Cl.[6] ..... G03G 15/02

[52] U.S. Cl. ..... 430/58; 430/59; 430/64

[58] Field of Search ..... 430/58, 59, 64, 430/78

[56] References Cited

U.S. PATENT DOCUMENTS

| | | | |
|---|---|---|---|
| 3,121,006 | 2/1964 | Middleton et al. | 430/59 |
| 3,357,989 | 12/1967 | Bryne et al. | 430/59 |
| 3,442,781 | 5/1969 | Weinberger | 430/59 |
| 4,265,990 | 5/1981 | Stolka et al. | 430/59 |
| 4,286,033 | 8/1981 | Neyhart et al. | 430/57 |
| 4,291,110 | 9/1981 | Lee | 430/59 |
| 4,338,387 | 7/1982 | Hewitt | 430/58 |
| 4,415,639 | 11/1983 | Horgan | 430/57 |
| 4,485,159 | 11/1984 | Watanabe et al. | 430/58 |
| 4,587,189 | 5/1986 | Hor et al. | 430/59 |
| 4,664,995 | 5/1987 | Horgan et al. | 430/59 |
| 4,758,488 | 7/1988 | Johnson et al. | 430/59 |
| 4,855,202 | 8/1989 | Yoshihara et al. | 430/58 |

*Primary Examiner*—S. Rosasco
*Attorney, Agent, or Firm*—Oliff & Berridge

[57] ABSTRACT

In a process for producing an electrophotographic imaging member, a charge transport layer is coated onto a support and the charge transport layer is laminated onto at least one lower layer of the electrophotographic imaging member. The electrophotographic imaging member includes a pre-formed transport layer laminated onto a lower layer of the electrophotographic imaging member.

15 Claims, 4 Drawing Sheets

ELECTROPHOTOGRAPHIC IMAGING MEMBER HAVING LAMINATED LAYERS

BACKGROUND OF THE INVENTION

This invention relates in general to electrophotography and, in particular, to electrophotoconductive imaging members having multiple layers.

In electrophotography, an electrophotographic plate, drum, belt or the like (imaging member) containing a photoconductive insulating layer on a conductive layer is imaged by first uniformly electrostatically charging its surface. The imaging member is then exposed to a pattern of activating electromagnetic radiation such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly to a support such as paper. This imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. A layered photoreceptor having separate photogenerating and charge transport layers is disclosed in U.S. Pat. No. 4,265,990. The photogenerating layer is capable of photogenerating charge and injecting the photogenerated charge into the charge transport layer.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements, including narrow operating limits, on photoreceptors.

The numerous layers found in many modern photoconductive imaging members must be highly flexible, adhere well to adjacent layers and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, an optional adhesive layer, a charge generating layer, and a charge transport layer. This photoreceptor may also comprise additional layers such as an anti-curl backing layer and an overcoating layer. This imaging member includes a substrate having a charge blocking layer which may be solution coated onto the substrate. If the optional adhesive layer is included, it is generally solution coated onto the charge blocking layer and the charge generating layer is deposited through vacuum sublimation followed by application of the charge transport layer. The transport layer may be solution coated or applied by evaporation techniques onto the charge generating layer.

This multilayered belt-imaging member exhibits excellent electrical properties and extended life. However, mud-cracking may be a problem with imaging members having vacuum sublimation-applied charge generating layers. Mud-cracking is a cracking of the charge generating layer in a pattern that resembles a drying water bed. The origin of mud-cracking is unknown but may be due to charge transport layer solvent penetrating through the thin charge generating layer to dissolve adhesive layer.

Cracking is a serious problem. Charge generating layer cracking may print out as a defect. Additionally, cracking may act as a stress concentration center to propagate further cracks into other layers during belt operation.

Many solutions have been proposed to solving the problem of cracking. These solutions have involved changes to transport solvent or to the adhesive polymer layer, None of the proposals has been completely successful.

SUMMARY OF THE INVENTION

In accordance with this invention a process for producing an electrophotographic imaging member comprises coating a charge transport layer onto a support and laminating the charge transport layer and support onto at least one layer of an electrophotographic imaging member. Further, the invention is directed to an electrophotographic imaging member comprising a preformed charge transport layer laminated to a layer of an electrophotographic imaging member. The resulting electrophotographic imaging member is characterized by a discrete interfacial boundary between the charge transport layer and the layer of the electrophotographic imaging member. The process permits application of the transport layer without cracking of the vacuum deposited charge generating layer. The process requires no alteration either to the adhesive layer or to the charge generating layer. Further, in some embodiments, the adhesive layer between the charge generating layer and the charge transport layer may be eliminated.

DESCRIPTION OF PREFERRED EMBODIMENTS

Figure 1:
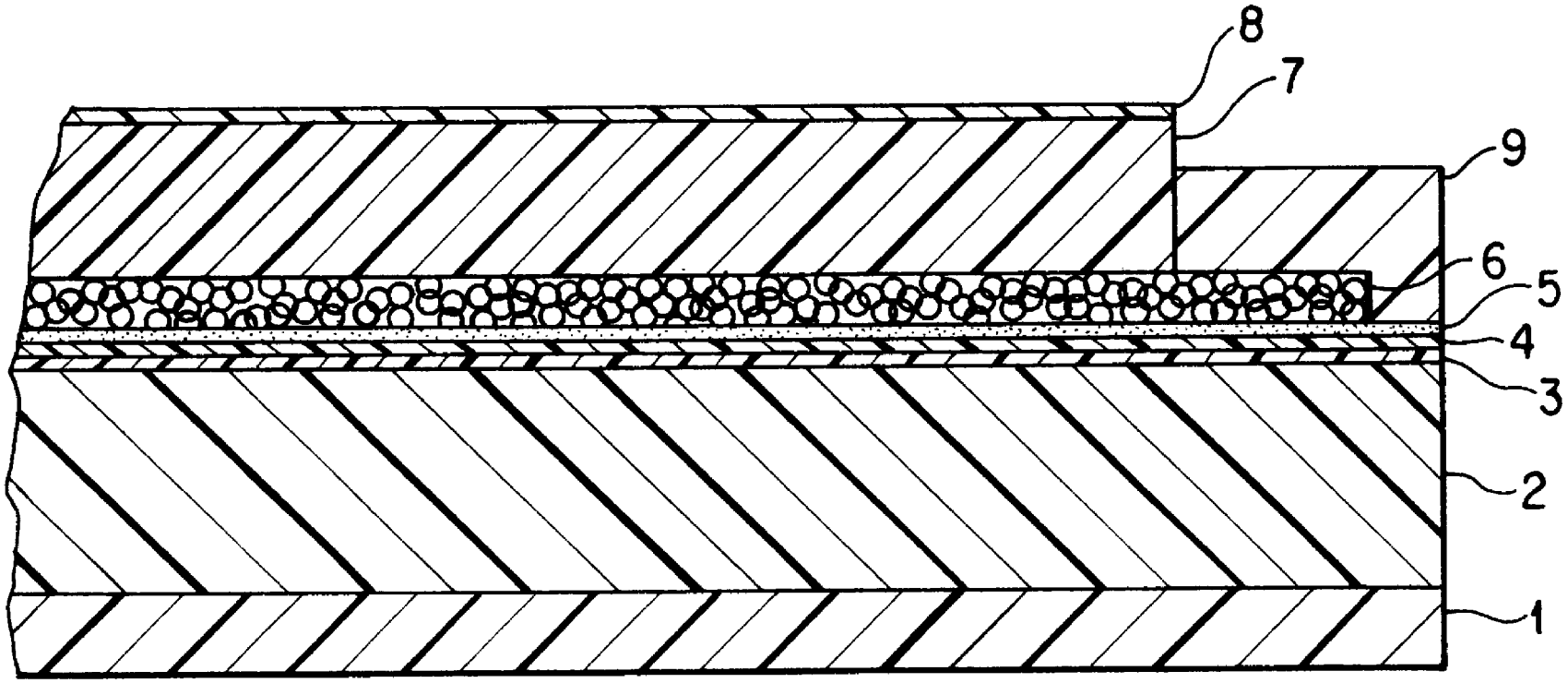
FIG. 1 is a cross-sectional view of a multilayer photoreceptor prepared by a process of the invention.

The electrophotographic imaging member shown in FIG. 1 includes a preformed charge transport layer 7 laminated onto the charge generating layer 6 of an electrophotographic imaging member in accordance with the invention. The imaging member is provided with anti-curl layer 1, a supporting substrate 2, an electrically conductive ground plane 3, a charge blocking layer 4, an adhesive layer 5, a charge generating layer 6, a charge transport layer 7, an overcoating layer 8 and conductive ground strip 9. A description of the layers of the electrophotographic imaging member and the method for producing the electrophotographic imaging member follows.

The Supporting Substrate

The supporting substrate 2 may be opaque or substantially transparent and may comprise numerous suitable materials having the required mechanical properties. The substrate may further be provided with an electrically conductive surface (ground plane 3). Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. For a belt-type imaging member, the electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E.I. du Pont de Nemours & Co., or Melinex available from ICI Americas Inc.

The preferred thickness of the substrate layer depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, 200 micrometers, or of minimum thickness, for example 50 micrometers, provided there are no adverse effects on the final photoconductive device. The surface of the substrate layer is preferably cleaned prior to coating to promote greater adhesion of the adjacent layer. Cleaning may be effected by exposing the surface of the substrate layer to plasma discharge, ion bombardment and the like.

The Electrically Conductive Ground Plane

The electrically conductive ground plane 3 may be an electrically conductive layer such as a metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures and alloys thereof. The conductive layer 3 may vary in thickness over substantially wide ranges depending on the optical transparency and flexibility desired for the electrophotoconductive member. Accordingly, for a flexible photoresponsive imaging device, the thickness of the conductive layer 3 is preferably between about 20 Angstroms to about 750 Angstroms, and more preferably from about 50 Angstroms to about 200 Angstroms for an optimum combination of electrical conductivity, flexibility and light transmission.

Regardless of the technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

Generally, for rear erase exposure, a conductive layer light transparency of at least about 15 percent is desirable. The conductive layer need not be limited to metals. Other examples of conductive layers are combinations of materials such as conductive indium tin oxide as a transparent layer for light having a wavelength between about 4000 Angstroms and about 9000 Angstroms or a conductive carbon black dispersed in a plastic binder as an opaque conductive layer. The conductive ground plane 3 may be omitted if a conductive substrate is used.

The Charge Blocking Layer

After deposition of any electrically conductive ground plane layer 3, a charge blocking layer 4 may be applied. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the photoconductive layer may be utilized.

The blocking layer 4 may include polymers such as polyvinylbutyral, epoxy resins, polyesters, polysiloxanes, polyamides, polyurethanes and the like; nitrogen-containing siloxanes or nitrogen-containing titanium compounds such as trimethoxysilyl propyl ethylene diamine, N-beta (aminoethyl) gamma-aminopropyl trimethoxy silane, isopropyl 4-aminobenzene sulfonyl titanate, di(dodecylbenzene sulfonyl) titanate, isopropyl di(4-aminobenzoyl)isostearoyl titanate, isopropyl tri(N-ethylamino) titanate, isopropyl trianthranil titanate, isopropyl tri(N,N-dimethylethylamino) titanate, titanium-4-aminobenzene sulfonate oxyacetate, titanium 4-aminobenzoate isostearate oxyacetate, $[H_2N(CH_2)_4]CH_3Si(OCH_3)_2$ (gamma-aminobutyl methyl dimethoxy silane), $[H_2N(CH_2)_3]CH_3Si(OCH_3)_2$ (gamma-aminopropyl methyl dimethoxy silane), and $[H_2N(CH_2)_3]Si(OCH_3)_3$ (gamma-aminopropyl trimethoxy silane) as disclosed in U.S. Pat. Nos. 4,338,387, 4,286,033 and 4,291,110. A preferred blocking layer 4 comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes have the general formula:

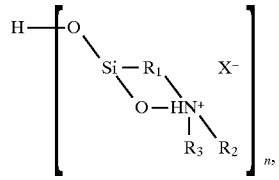

or

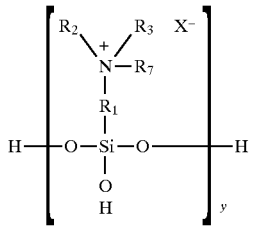

wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4.

The blocking layer 4 should be continuous and have a thickness of less than about 0.5 micrometer because greater thicknesses may lead to undesirable high residual voltage. A blocking layer 4 of between about 0.005 micrometer and about 0.3 micrometer is satisfactory because charge neutralization after the exposure step is facilitated and good electrical performance is achieved. A thickness between about 0.03 micrometer and about 0.06 micrometer is preferred for optimum electrical behavior.

The blocking layer 4 may be applied by any suitable technique such as spraying, dip coating, draw bar coating, gravure coating, silk screening, air knife coating, reverse roll coating, vacuum deposition, chemical treatment and the like. For convenience in obtaining thin layers, the blocking layer 4 is preferably applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

The Adhesive Layer

Intermediate layers between the blocking layer 4 and the charge generating or photogenerating layer 6 may be desired to promote adhesion. For example, an adhesive layer 5 may be employed, if such a layer is utilized, preferably it has a dry thickness between about 0.01 micrometer to about 0.3 micrometer, more preferably about 0.05 to about 0.2 micrometer.

Typical adhesive layers include film-forming polymers such as polyester, du Pont 49,000 resin (available from E.I. du Pont de Nemours & Co.), Vitel 1200 (available from Goodyear Rubber & Tire Co.), polyvinylbutyral, polyvinylpyrrolidone, polyurethane, polymethyl methacrylate, or the like. Both the du Pont 49,000 and Vitel 1200 adhesive layers are preferred because they provide reasonable adhesion strength and produce no deleterious electrophotographic impact on the resulting imaging members.

Both du Pont 49,000 and Vitel 1200 are polyester resins that are the reaction product of different diacids and an aliphatic diol. Du Pont 49,000 is a linear saturated copolyester of four diacids and ethylene glycol having a molecular weight of about 70,000 and a glass transition temperature of 32° C. Its molecular structure is represented as $$HO-\overset{\overset{\displaystyle O}{\|}}{C}-[\text{diacid-ethylene glycol}]_n-OH$$

where n is a number which represents the degree of polymerization and gives a molecular weight of about 70,000. The ratio of diacid to ethylene glycol in the copolyester is 1:1. The diacids are terephthalic acid, isophthalic acid, adipic acid and azelaic acid in a ratio of 4:4:1:1.

Vitel 1200 is a linear copolyester of two diacids and ethylene glycol having a weight average molecular weight of about 49,000 and a glass transition temperature of 71° C. Its molecular structure is represented as $$HO-\overset{\overset{\displaystyle O}{\|}}{C}-[\text{diacid-ethylene glycol}]_n-OH$$

where n is a number which represents the degree of polymerization and gives a weight average molecular weight of about 49,000. The ratio of diacid to ethylene glycol in the copolyester is 1:1. The two diacids are terephthalic acid and isophthalic acid in a ratio of 3:2.

The Charge Generating Layer

The charge generating (photogenerating) layer 6 may be applied onto the adhesive layer 5. Examples of materials for photogenerating layers include inorganic photoconductive particles such as amorphous selenium, trigonal selenium, and selenium alloys selected from the group consisting of selenium-tellurium, selenium-tellurium-arsenic, and selenium arsenide; phthalocyanine pigment such as the X- form of metal-free phthalocyanine described in U.S. Pat. No. 3,357,989; metal phthalocyanines such as vanadyl phthalocyanine and copper phthalocyanine; dibromoanthanthrone; squarylium; quinacridones such as those available from du Pont under the tradename Monastral Red, Monastral Violet and Monastral Red Y; dibromo anthanthrone pigments such as those available under the trade names Vat orange 1 and Vat orange 3; benzimidazole perylenes; substituted 2,4-diamino-triazines such as those disclosed in U.S. Pat. No. 3,442,781; polynuclear aromatic quinones such as those available from Allied Chemical Corporation under the tradenames Indofast Double Scarlet, Indofast Violet Lake B. Indofast Brilliant Scarlet and Indofast Orange; and the like. Also suitable are combination photogenerating layers that include a photoconductive layer to enhance or reduce the properties of the photogenerating material. Examples of this type of configuration are described in U.S. Pat. No. 4,415,639. Other suitable photogenerating materials known in the art may also be utilized, if desired.

Charge generating layers comprising a photoconductive material such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal-free phthalocyanine and tellurium alloys are also preferred because these materials provide the additional benefit of being sensitive to infrared light.

Charge generating layers may be applied onto other layers by solvent coating or by vapor deposition. Mud-cracking is a problem usually associated with vapor-deposited charge generating layers. The present invention overcomes mud-cracking. However, the invention is applicable to any electrophotographic imaging member whether the charge generating layer is applied by solvent coating, by vapor deposition or otherwise.

Examples of materials for vapor deposition of photogenerating layers include photoconductive perylene and phthalocyanine pigments, for example, benzimidazole perylene and chloroindium phthalocyanine. Other typical phthalocyanine pigments include the X-form of metal free phthalocyanine described in U.S. Pat. No. 3,357,989, and metal phthalocyanines in the form of vanadyl phthalocyanine, titanyl phthalocyanine and copper phthalocyanine. Other pigments of interest include, for example, dibromoanthanthrone; squarylium; quinacridones such as those available from du Pont under the tradename Monastral Red, Monastrat Violet and Monastral Red Y; dibromo anthanthrone pigments such as those available under the tradenames Vat Orange 1 and Vat Orange 3; substituted 2,4-diamino-triazines disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange; and the like.

Use of a vapor deposition process such as a vacuum sublimation deposition process is especially desirable to obtain a thin charge generating layer without the need of a polymer binder. Generally, the charge generating material is heated to a temperature sufficient for vaporization. A vacuum may be utilized to facilitate vaporization and, depending upon the material utilized, prevent decomposition. The substrate to be coated is maintained at a temperature below the condensation temperature of the charge generating material vapors. A typical technique for vapor deposition of charge generating layers is disclosed, for example, in U.S. Pat. No. 4,587,189.

Thin charge generating layers are desirable because they permit intimate pigment-to-pigment contact and provide a shorter charge carrier travel path to the charge transport layer for efficient electrophotographic imaging process enhancement.

Photogenerating layers containing vacuum deposited photoconductive compositions generally range in thickness of from about 0.1 micrometer to about 5 micrometers, and preferably have a thickness of from about 0.2 micrometer to about 3 micrometers. A thickness between about 0.3 and about 1 micrometers gives best results. Thicknesses outside these ranges can be selected providing the objectives of the present invention are achieved. Other suitable photogenerating materials known in the art and which can be vapor, solution or otherwise deposited may also be utilized, if desired.

Additionally, the charge generating layer 6 may be applied by solution coating of a solvent containing the photogenerating pigment with or without a film-forming binder material. If a film-forming binder material is employed, typical polymeric film-forming materials include those described in U.S. Pat. No. 3,121,006. When an adhesive layer is used, the binder polymer should dissolve in a solvent which also dissolves the upper surface of the adhesive layer and be miscible with the polymer of the adhesive layer to form a polymer blend zone. The solvent for the charge generating layer binder polymer should dissolve the polymer binder utilized in the charge generating layer and be capable of dispersing the photogenerating pigment particles present in the charge generating layer. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride.

If a binder is present, the photogenerating composition or pigment may be present in the resinous binder in various amounts. Generally, from about 5 to 90 percent by volume of the photogenerating pigment is dispersed in about 95 to 10 percent by volume of the resinous binder. Preferably from about 20 percent by volume to about 30 percent by volume of the photogenerating pigment is dispersed in about 80 percent by volume to about 70 percent by volume of the resinous binder composition. However, when trigonal selenium photogenerating pigment is used, only a low pigment concentration of about 8 percent by volume is acceptable to give good quality coating due to the coating difficulty associated with selenium loading.

The photogenerating layer 6 applied by solution coating generally ranges in thickness from about 0.1 micrometer to about 5.0 micrometers, preferably from about 0.3 micrometer to about 3 micrometers. The photogenerating layer-thickness is related to binder content. Higher binder content compositions generally require thicker layers to give equivalent pigment coverage for identical photogeneration capability. Thicknesses outside these ranges can be selected, providing the objectives of the present invention are achieved.

Any suitable and conventional technique may be utilized to mix and thereafter apply the photogenerating layer coating mixture to the previously applied layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all solvents utilized in applying the coating.

The Charge Transport Layer

The charge transport layer 7 may comprise any suitable transparent organic polymer or non-polymeric material capable of supporting the injection of photogenerated holes or electrons from the charge generating layer 6 and allowing the transport of these holes or electrons to selectively discharge the surface charge. The charge transport layer not only serves to transport holes or electrons, but also protects the charge generating layer from abrasion or chemical attack and therefore extends the operating life of the imaging member.

The charge transport layer should exhibit negligible, if any, discharge when exposed to a wavelength of light useful in xerography, e.g., 4000 Angstroms to 9000 Angstroms. The charge transport layer is substantially transparent to radiation in a region in which the imaging member is to be used. The charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the charge transport material need not transmit light in the wavelength region of use.

The charge transport layer may comprise activating compounds dispersed in normally electrically inactive polymeric materials for making these materials electrically active. These compounds may be added to polymeric materials which are incapable of supporting the injection of photogenerated charge and incapable of allowing the transport of this charge. An especially preferred transport layer employed in multilayer photoconductors comprises from about 25 percent to about 75 percent by weight of at least one charge transporting aromatic amine compound, and about 75 percent to about 25 percent by weight of a polymeric film-forming resin in which the aromatic amine is soluble.

The charge transport layer is preferably formed from a mixture comprising one or more compounds having the general formula:

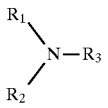

wherein $R_1$ and $R_2$ are selected from the group consisting of substituted or unsubstituted phenyl groups, naphthyl groups, and polyphenyl groups and $R_3$ is selected from the group consisting of substituted or unsubstituted aryl groups, alkyl groups having from 1 to 18 carbon atoms and cycloaliphatic groups having from 3 to 18 carbons atoms. The substituents should be free from electron-withdrawing groups such as $NO_2$ groups, CN groups, and the like.

Examples of charge-transporting aromatic amines represented by the structural formula above include triphenylmethane, bis(4-diethylamine-2-methylphenyl)-phenylmethane; 4,4'-bis(diethylamino)-2,2'- dimethyltriphenylmethane; N,N'-bis(alkyl-phenyl)-(1,1'- biphenyl)-4,4'-diamine wherein the alkyl is, for example, methyl, ethyl, propyl, n-butyl, etc.; N,N'-diphenyl-N,N'-bis(3-methytphenyl)-(1,1'-biphenyl)4,4'-diamine; and the like, dispersed in an inactive resin binder.

Any suitable inactive resin binder soluble in methylene chloride or other suitable solvents may be employed. Typical inactive resin binders soluble in methylene chloride include polycarbonate resin, polyvinylcarbazole, polyester, polyacrylate, polyether, polysulfone, and the like. Molecular weights can vary from about 20,000 to about 1,500,000. Other solvents that may dissolve these binders include tetrahydrofuran, toluene, trichloroethytene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin materials are poly(4,4'-dipropylidenediphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farbenfabricken Bayer A. G.; a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The charge transport layer is coated onto a support and subsequently laminated by adhesive or otherwise onto the charge generating layer. The support material is a material that provides a base for preformation of the charge transport layer. The support provides a layered composition that will not disintegrate while manipulated into position on the charge generating layer. Further, the support may be peelable from the charge transport layer after application to the charge generating layer, or the support may remain as part of the electrophotographic imaging member as, e.g., an overcoating. In the instance the support remains as an overcoating it must be of a material that is not detrimental to the electrophotographic properties of the imaging member. Otherwise, the support may be any material capable of forming a substrate such as a sheet, film or rubber-forming polymer. Suitable materials for the support include film or sheet-forming polyesters such as Mylar, available from E. I. du Pont de Nemours & Co., polytetrafluoroethylenes such as Teflon available from E. I. du Pont de Nemours & Co., polycarbonate resins such as Lexan, available from General Electric Company, polymethacrylate polymers such as Plexiglas from Rohm & Haas Company and thermoplastic rubbers such as polymers of propylene/ethylene-propylene diene monomers and styrene/ethylenebutylene. Also suitable are inorganic materials, coated and uncoated. Preferred materials suitable for the support are film-forming polyesters, polytetrafluoroethylenes and titanium coated polyesters.

The charge transport layer after coating onto the support may be subsequently laminated by an adhesive to the charge generating layer. In such instance, suitable adhesives include those which may form the optional intermediate layer between the blocking layer 4 and the charge generating layer 6. In the instance an adhesive is utilized, it may be applied onto the charge generating layer to provide a dry thickness between about 0.01 micrometer to 5 micrometer, preferably between 0.02 micrometer and 0.5 micrometer. In addition to the adhesives disclosed as suitable between the blocking layer 4 and the charge generating layer 6 are film forming polymers such as polyethylene, polyvinyl butyral, polyvinylpyrrolidones, polyurethanes, polymethyl methacrylates and the like.

Figure 2:
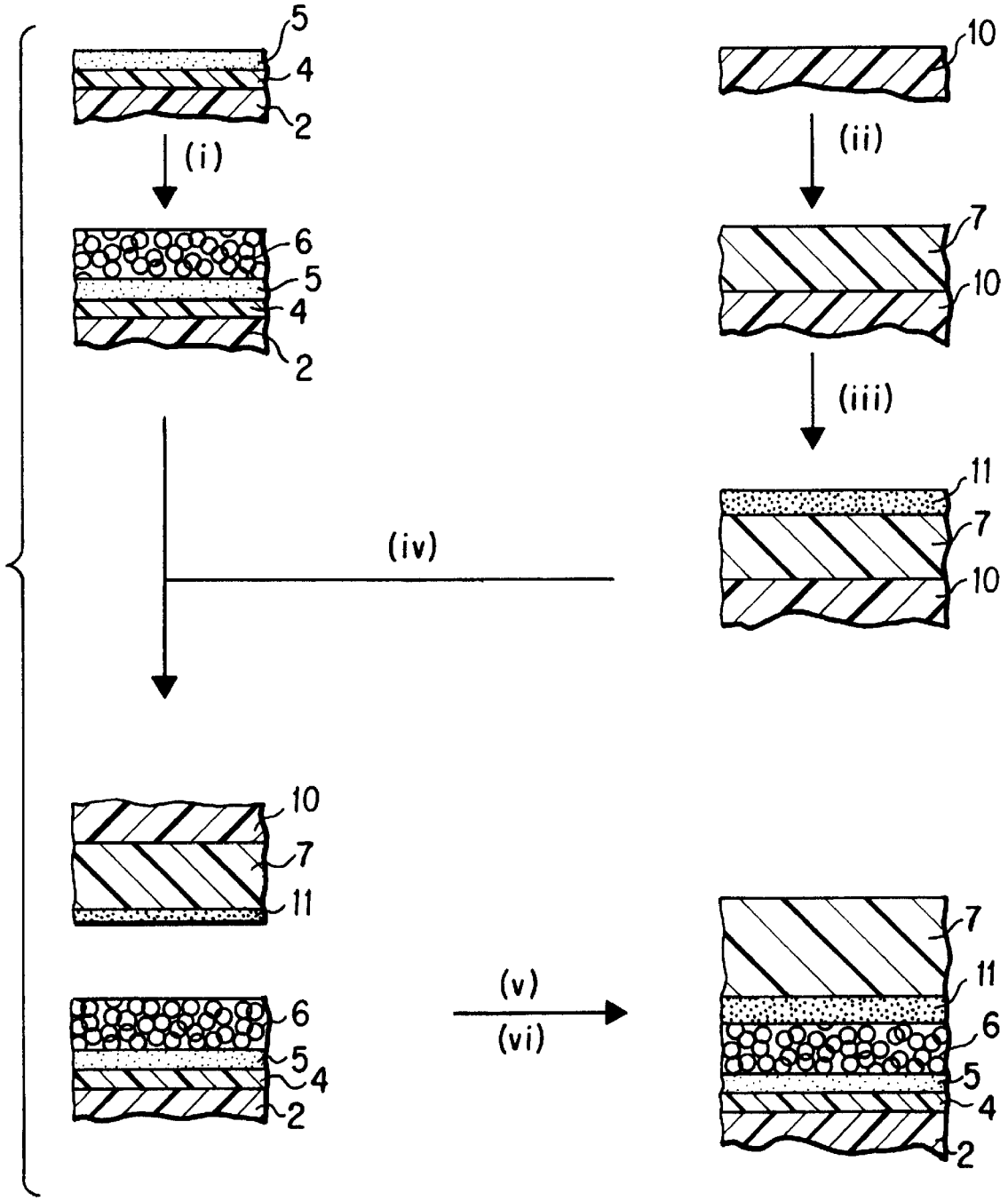
FIG. 2 is a schematic representation of a process of the invention.

With reference to FIG. 2 of the drawings, Step (i) illustrates the application of a charge generating layer 6 to a composition of substrate 2 and charge blocking layer 4 and with an adhesive film 5 that secures the charge generating layer 6 to the blocking layer 4. Separate formation of transport layer 7 on suitable support 10 is illustrated in (ii). Step (iii) illustrates an optional step of the application of an adhesive layer 11 to the side of the transport layer 7 opposite the side adjacent the support 10. After formation of the transport layer 7 upon the support 10, either with or without adhesive layer 11, the composite of transport layer 7 and support 10 is applied (iv) onto the lower layers of the electrophotographic imaging member. The composition is laminated by one or more of heat, pressure, UV irradiation or the like (v), and the support 10 is removed (e.g., peeled) (vi) from the composite to form the electrophotographic imaging member of the invention. The electrophotographic imaging member comprises the preformed charge transport layer 7 laminated onto the lower layers of the imaging member. Since the transport layer 7 is preformed, the resulting imaging member is characterized by a discrete interfacial boundary between the charge transport layer 7 and the charge generating layer 6.

Any suitable and conventional technique may be utilized to mix and thereafter apply (ii) the charge transport coating mixture to the support 10. Typical application techniques include spraying, dip coating, roll coating, wire wound rod coating and the like. Drying of the deposited layer on the support may be effected by any suitable conventional technique such as oven-drying, infrared radiation drying, air drying and the like, to remove substantially all of the solvents utilized in applying the layer. The charge transport layer 7 and support 10 may then be applied to the charge generating layer 6 or to the optional adhesive layer 11 by applying the charge transport layer 7 and support 10 with the charge transport layer 7 adjacent and in contact with the charge generating layer. In another embodiment of the present invention, adhesive layer 11 is applied to the transport layer 7 prior to application of the combined transport layer 7 and support 10 to the charge generating layer 6. After application of the support 10 and charge transport layer 7 to the charge generating layer 6 either with or without an adhesive layer 11, the charge transport layer 7 is laminated to the charge generating layer 6 by known processes in the art, for example, by the application of heat and/or pressure and/or ultraviolet light or by means of an adhesive layer (v). The support may be peeled (vi) from the resulting laminated structure to provide a transport layer 7 applied to a charge generating layer 6 as part of the photoreceptor device. The support may, for example, be peeled from the charge transport layer by initiating delamination with a razor blade. The support may thus be hand peeled until the charge transport layer is exposed. The photoreceptor device may then be secured and the support peeled completely at 180° to the charge transport layer.

The resulting device is characterized by a preformed charge transport layer laminated to a charge generating layer with a discrete interfacial boundary between the two layers.

The Ground Strip

The ground strip 9 may comprise a film-forming polymer binder and electrically conductive particles. Cellulose may be used to disperse the conductive particles. Any suitable electrically conductive particles may be used in the electrically conductive ground strip layer 9. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

In the described device, the ground strip 9 is preferably provided adjacent the charge transport layer 7 at an outer edge of the imaging member. See U.S. Pat. No, 4,664,995. The ground strip 9 is coated adjacent to the charge transport layer 7 so as to provide grounding contact with the grounding device (not shown) during electrophotographic processes.

The Anti-Curl Layer

The anti-curl layer 1 is optional, and may comprise organic polymers or inorganic polymers that are electrically insulating or slightly semi-conductive. The anti-curl layer provides flatness and/or abrasion resistance.

Anti-curl layer 1 may be formed at the back side of the substrate 2, opposite to the imaging layers. The anti-curl layer may comprise a film-forming resin and an adhesion promoter polyester additive. Examples of film-forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film-forming resin addition. The thickness of the anti-curl layer 1 is from about 3 micrometers to about 35 micrometers, and preferably about 14 micrometers, The anti-curl coating may be applied as a solution prepared by dissolving the film forming resin and the adhesion promoter in a solvent such as methylene chloride. The solution is applied to the rear surface of the supporting substrate (the side opposite to the imaging layers) of the photoreceptor device by hand coating or by other methods known in the art. The coating wet film is then dried to produce the anti-curl layer 1.

The Overcoating Layer

The optional overcoating layer 8 may comprise organic polymers or inorganic polymers that are capable of transporting charge through the overcoat. The overcoating layer may range in thickness from about 2 micrometers to about 8 micrometers, and preferably from about 3 micrometers to about 6 micrometers. An optimum range of thickness is from about 3 micrometers to about 5 micrometers.

The optional overcoat layer may be used to improve surface hardness and resistance to abrasion. The surface layer of the electrophotographic imaging member may be coated with one or more electrically insulating organic polymer coatings or electrically insulating, in organic coatings. The coating may be applied by any conventional means.

In one embodiment of the present invention, the charge transport layer is coated to the support, the transport layer and support are laminated onto the electrophotographic imaging member and the support is retained as an integral part of the electrophotographic imaging member as the overcoating layer. In another embodiment, the overcoating layer is coated onto a support and the charge transport layer is applied onto both the overcoating layer and the support. The charge transport layer, support and overcoating are then laminated onto the charge generating layer.

The invention will further be illustrated in the following, non-limiting examples, it being understood that these examples are intended to be illustrative only and that the invention in not intended to be limited to the materials, conditions, process parameters and the like recited therein.

EXAMPLE 1

A control photoconductive imaging member is prepared by providing a web of titanium coated polyester (Melinex, available from ICI Americas- Inc.) substrate having a thickness of 3 mils, and applying thereto, with a gravure applicator, a solution containing 50 grams of 3-aminopropyltriethoxysilane, 15 grams acetic acid, 684.8 grams of 200 proof denatured alcohol and 200 grams heptane. This layer is dried for about 5 minutes at 135° C. in the forced air drier of the coater. The resulting blocking layer has a dry thickness of 0.05 micrometer.

An adhesive interface layer is prepared by applying a wet coating over the blocking layer, using a gravure applicator. The wet coating contains 5.0 percent by weight based on total weight of a solution of copolyester adhesive (du Pont 49,000, available from E.I. du Pont de Nemours & Co.) in a 70:30 volume ratio mixture of tetrahydrofuran/cyclohexanone. The resulting adhesive interface layer is dried for about 5 minutes at 135° C. in the forced air drier of the coater. The resulting adhesive interface layer has a dry thickness of 620 Angstroms.

A benzimidazole perylene charge generating pigment is vacuum sublimation deposited over the du Pont 49,000 polyester adhesive layer from a heated crucible. The sublimation deposition process is carried out in a vacuum chamber under about $4\times10^{5}$ mm Hg pressure and a crucible temperature of about 550° C. During vapor deposition, the deposited benzimidazole perylene layer is at an elevated temperature while the adhesive coated substrate is maintained below the condensation temperature of the benzimidazole perylene vapors until a 0.7 micrometer thick benzimidazole perylene layer is formed.

This photogenerator layer is overcoated with a charge transport layer. The charge transport layer is prepared by introducing into an amber glass bottle in a weight ratio of 1:1, N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Farbenfabriken Bayer A. G. The resulting mixture is dissolved in methylene chloride to form a solution containing 15 percent by weight solids. This solution is applied onto the photogenerator layer using a Bird applicator to form a coating which upon drying has a thickness of 24 micrometers. The resulting photoreceptor device containing all of the above layers is annealed at 135° C. in a forced air oven for 5 minutes and thereafter cooled to ambient room temperature.

After application of the charge transport layer coating, an anti-curl coating is applied. The anti-curl coating solution is prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle is covered tightly and placed on a roll mill for about 24 hours until total dissolution of the polycarbonate and the copolyester is achieved. The anti-curl coating solution thus obtained is applied to the rear surface of the supporting substrate (the side opposite to the imaging layers) of the photoreceptor device by hand coating using a 3 mil gap Bird applicator. The coated wet film is dried at 135° C. in an air circulation oven for about 5 minutes to produce a dry, 14 micrometers thick anti-curl layer.

EXAMPLE II

A photoconductive imaging member is prepared by providing a web of titanium coated polyester (Melinex, available from ICI Americas Inc.) substrate having a thickness of 3 mils, and applying thereto, with a gravure applicator, a solution containing 50 grams 3-aminopropyltriethoxysilane, 15 grams acetic acid, 684.8 grams of 200 proof denatured alcohol and 200 grams heptane. This layer is dried for about 5 minutes at 135° C. in the forced air drier of the coater. The resulting blocking layer has a dry thickness of 0.05 micrometer.

An adhesive interface layer is prepared by applying a wet coating over the blocking layer, using a gravure applicator. The wet coating contains 5.0 percent by weight based on the total weight of the solution of copolyester adhesive (du Pont 49,000 available from E.I. du Pont de Nemours & Co.) in a 70:30 volume ratio mixture of tetrahydrofuran/cyclohexanone. The adhesive interface layer is then dried for about 5 minutes at 135° C. in the forced air drier of the coater. The resulting adhesive interface layer has a dry thickness of 620 Angstroms.

A benzimidazole perylene charge generating pigment is vacuum sublimation deposited over the du Pont 49,000 polyester adhesive layer from a heated crucible. The sublimation deposition process is carried out in a vacuum chamber under about $4\times10^{-5}$ mm Hg pressure and a crucible temperature of about 550° C. During vapor deposition, the deposited benzimidazole perylene layer is at an elevated temperature while the adhesive coated substrate is maintained below the condensation temperature of the benzimidazole perylene vapors until a 0.7 micrometer thick benzimidazole perylene layer is formed.

EXAMPLE III

A charge transport layer is coated onto a support. The charge transport layer is prepared by introducing into an amber glass bottle in a weight ratio of 1:1, N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Farbenfabriken Bayer AG. The resulting mixture is dissolved in methylene chloride to form a solution containing 15 percent by weight solids. This solution is applied to a web of titanium coated polyester (Melinex, available from ICI Americas Inc.) substrate having a thickness of 3 mils by using a Bird applicator to form a coating which upon drying has a thickness of 24 micrometers. During this coating process the humidity is equal to or less than 15 percent. The resulting charge transport layer is annealed at 135° C. in a forced air oven for 5 minutes and thereafter cooled to ambient room temperature.

An adhesive interface layer is then prepared by applying a wet coating over the charge transport layer, using a gravure applicator containing 5.0 percent by weight based on the total weight of a solution of copolyester adhesive (du Pont 49,000 available from E.I. du Pont de Nemours & Co,) in a 70:30 volume ratio mixture of tetrahydrofuran/cyclohexanone. The adhesive interface layer is then dried for about 5 minutes at 135° C. in the forced air-drier of the coater, The resulting adhesive interface layer has a dry thickness of 620 Angstroms.

EXAMPLE IV

The device from Example II is laminated onto the device of Example III by placing the support side of the charge transport layer onto a heated platen at a temperature of 800° C. The charge generator layer is placed facing the adhesive layer (as in FIG. 2) and pressure is applied by means of a roller. After cooling the device, the support is removed from the charge transport layer by peeling it back at a 180° angle to the transport layer.

Figure 3:
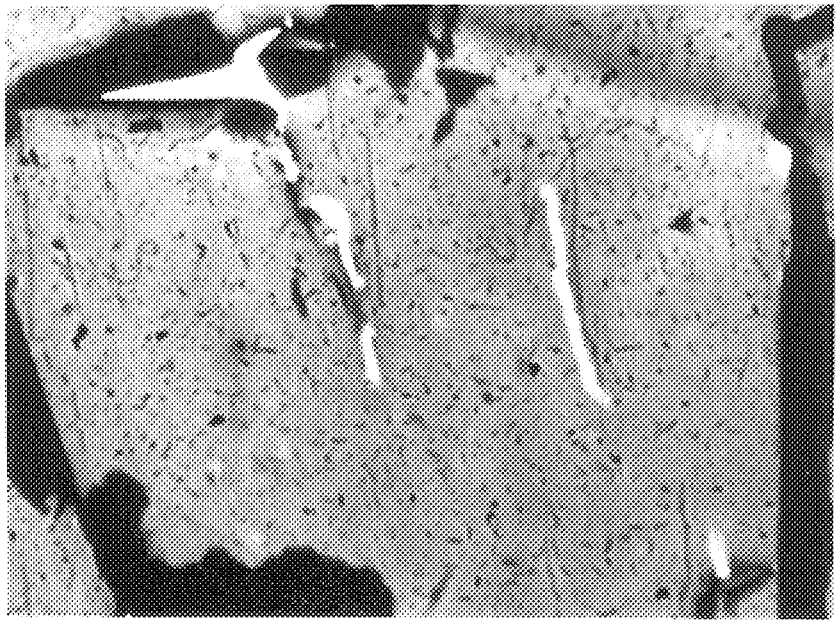
FIG. 3 is a 400 times magnification electromicroscope photograph of a multilayer photoreceptor with solvent coated charge transport layer.
Figure 4:
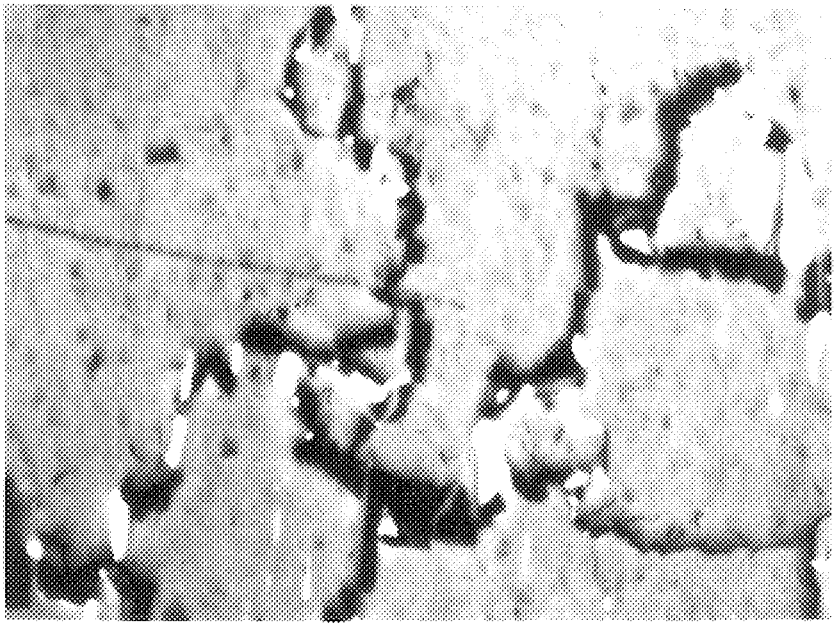
FIG. 4 is a 100 times magnification of the multilayer photoreceptor of FIG. 3.
Figure 5:
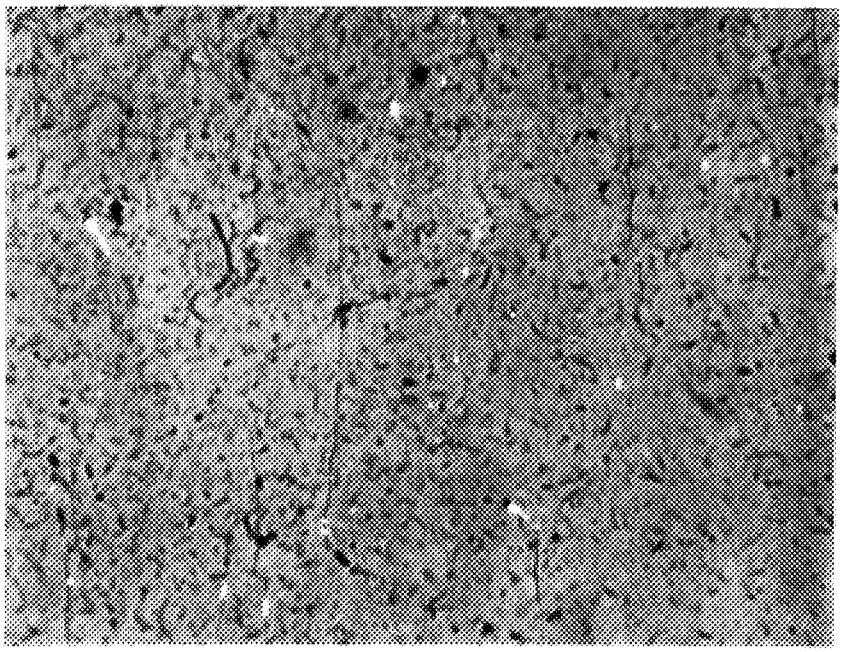
FIG. 5 is a 400 times magnification electromicroscope photograph of a multilayer photoreceptor prepared by a process of the invention.

Each of the devices of Example I and Example IV is examined under a microscope. FIG. 3 is a 400× magnification electromicroscope photograph of the multilayer photoreceptor of Example 1 showing characteristic mud-cracking. At 100×magnification, the mud-cracking of the photoreceptor of Example I appears as shown in FIG. 4. FIG. 5 is a 400×magnification electromicroscope photograph of the multilayer photoreceptor produced by the process of Examples II through IV. This photoreceptor shows no mud-cracking.

What is claimed is:

1. A process of producing an electrophotographic imaging member comprising:

coating a charge transport layer onto a removable support; and laminating said charge transport layer and support onto a charge generating layer preformed on a substrate of an electrophotographic imaging member having an adhesive layer between said charge generating layer and said substrate.

2. The process of claim 1, wherein said charge transport layer is coated onto the support by the process of solvent coating.

3. The process of claim 1, further comprising applying a charge blocking layer over a substrate, applying a charge generating layer over said charge blocking layer and laminating said charge transport layer onto said charge generating layer.

4. The process of claim 3, further comprising applying an adhesive layer onto said charge blocking layer and applying said charge generating layer onto said adhesive layer.

5. The process of claim 4, wherein said charge generating layer is applied by vapor deposition.

6. The process of claim 3, wherein said charge generating layer is applied by vapor deposition.

7. The process of claim 1, wherein said charge transport layer is laminated onto said layer of an electrophotographic imaging member by application of heat, pressure or heat and pressure.

8. The process of claim 1. further comprising removing said support from said charge transport layer.

9. The process of claim 1, wherein said support is selected from the group consisting of film forming polyesters, polytetrafluoroethylenes and titanium-coated polyesters.

10. The process of claim 1, further comprising applying an adhesive onto a side of said charge transport layer opposite from said support and thereafter applying the transport layer and support with applied adhesive onto said layer of an electrophotographic imaging member.

11. An electrophotographic imaging member comprising a preformed charge transport layer coated onto a removable support on one side and laminated on the other side to a charge generating layer preformed on an adhesive layer on a substrate of an electrophotographic imaging member.

12. The electrophotographic imaging member of claim 11, additionally comprising an adhesive layer between said charge transport layer and said charge generating layer.

13. The electrophotographic imaging member of claim 11, additionally comprising a charge blocking layer and an adhesive layer between said charge generating layer and said charge blocking layer.

14. The electrophotographic imaging member of claim 13, wherein said adhesive layer comprises a polyester resin.

15. The electrophotographic imaging member of claim 11, wherein said support is selected from the group consisting of film forming polyesters, polytetrafluoroethylenes and titanium-coated polyesters.

* * * * *